US011082767B1

(12) United States Patent
Porter

(10) Patent No.: US 11,082,767 B1
(45) Date of Patent: Aug. 3, 2021

(54) NONLINEAR SUSPENSION COMPONENT IN A TISSUE CONDUCTING VIBRATION ISOLATION SYSTEM

(71) Applicant: Facebook Technologies, LLC, Menlo Park, CA (US)

(72) Inventor: Scott Porter, Woodinville, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 25 days.

(21) Appl. No.: 16/774,764

(22) Filed: Jan. 28, 2020

Related U.S. Application Data

(60) Provisional application No. 62/907,604, filed on Sep. 28, 2019.

(51) Int. Cl.
*H04R 1/02* (2006.01)
*H04R 1/10* (2006.01)

(52) U.S. Cl.
CPC ..... *H04R 1/1091* (2013.01); *H04R 1/1075* (2013.01); *H04R 2460/13* (2013.01)

(58) Field of Classification Search
CPC . H04R 1/00; H04R 1/02; H04R 1/028; H04R 1/05; H04R 1/10; H04R 1/1041; H04R 1/1075; H04R 1/1091; H04R 7/045; H04R 17/00; H04R 2400/07; H04R 2460/13
See application file for complete search history.

(56) References Cited

U.S. PATENT DOCUMENTS 4,607,382 A * 8/1986 Dijkstra ..... H04R 1/42 381/392
6,629,460 B2 * 10/2003 Chailoner ..... G01C 19/5719 73/504.02
6,885,753 B2 * 4/2005 Bank ..... H04M 1/05 381/151
2002/0061115 A1 * 5/2002 Chung ..... H04R 9/06 381/398
2004/0016307 A1 * 1/2004 Albert ..... G01L 1/106 73/862.627
2007/0164189 A1 * 7/2007 Corsaro ..... F16F 15/005 248/614
2018/0340776 A1 * 11/2018 Kuisma ..... G01C 19/5747
2018/0340955 A1 * 11/2018 Kuisma ..... H01L 41/0946

* cited by examiner

*Primary Examiner* — Thang V Tran
(74) *Attorney, Agent, or Firm* — Fenwick & West LLP

(57) ABSTRACT

A tissue conduction audio system includes a transducer that produces vibrations as it presents audio to a user. A vibration isolation system isolates the vibrations produced by the transducer. The vibration isolation system includes a suspension component with flexures that are configured to have an asymmetric spring rate when at rest and a symmetric spring rate when the transducer is in use and/or at a target position.

18 Claims, 6 Drawing Sheets

400

NONLINEAR SUSPENSION COMPONENT IN A TISSUE CONDUCTING VIBRATION ISOLATION SYSTEM

CROSS-REFERENCE TO RELATED APPLICATIONS

This application claims the benefit of U.S. Provisional Application No. 62/907,604, filed Sep. 28, 2019, which is incorporated by reference in its entirety.

FIELD OF THE INVENTION

This disclosure relates generally to vibration isolation systems, and more specifically to a nonlinear suspension component in a tissue conducting vibration isolation system.

BACKGROUND

As consumer electronics devices become more personal and wearable, internal components become increasingly proximate to each other, which can result in undesirable couplings (sometimes called co-existence issues) between components. A device may include mechanical and acoustic components that transfer unwanted excitation energy to other mechanical components, sensors, resonant structures, and/or the user of the device. Audio presented to the user may generate vibrations that affect other systems on the device (e.g., audio capture). These vibrations may become salient to the user of the device, presenting an uncomfortable use experience for the user. Additionally, when such mechanical and acoustic components require a pre-loading force to keep in contact with the wearer, the force may change the operating state of the component with the net effect of degradation to the audio quality.

SUMMARY

A headset with a tissue conducting audio system includes a vibration isolation system to damp vibrations from a transducer configured to present audio to a user. The vibration isolation system includes a nonlinear suspension component with flexures configured to be displaced while bearing a load.

In some embodiments, a vibration isolation system comprises a suspension component that includes a plurality of flexures that together are configured to isolate vibrations produced by a transducer. The plurality of flexures includes at least one set of flexures that have a symmetric spring rate over displacement while in a target position and an asymmetric spring rate while in a resting position.

In some embodiments, a system comprises a transducer configured to present audio, wherein the transducer produces vibrations while presenting the audio. The system also comprises at least one set of flexures with a symmetric spring rate in a target position and an asymmetric spring rate in a resting position.

Figure 1:
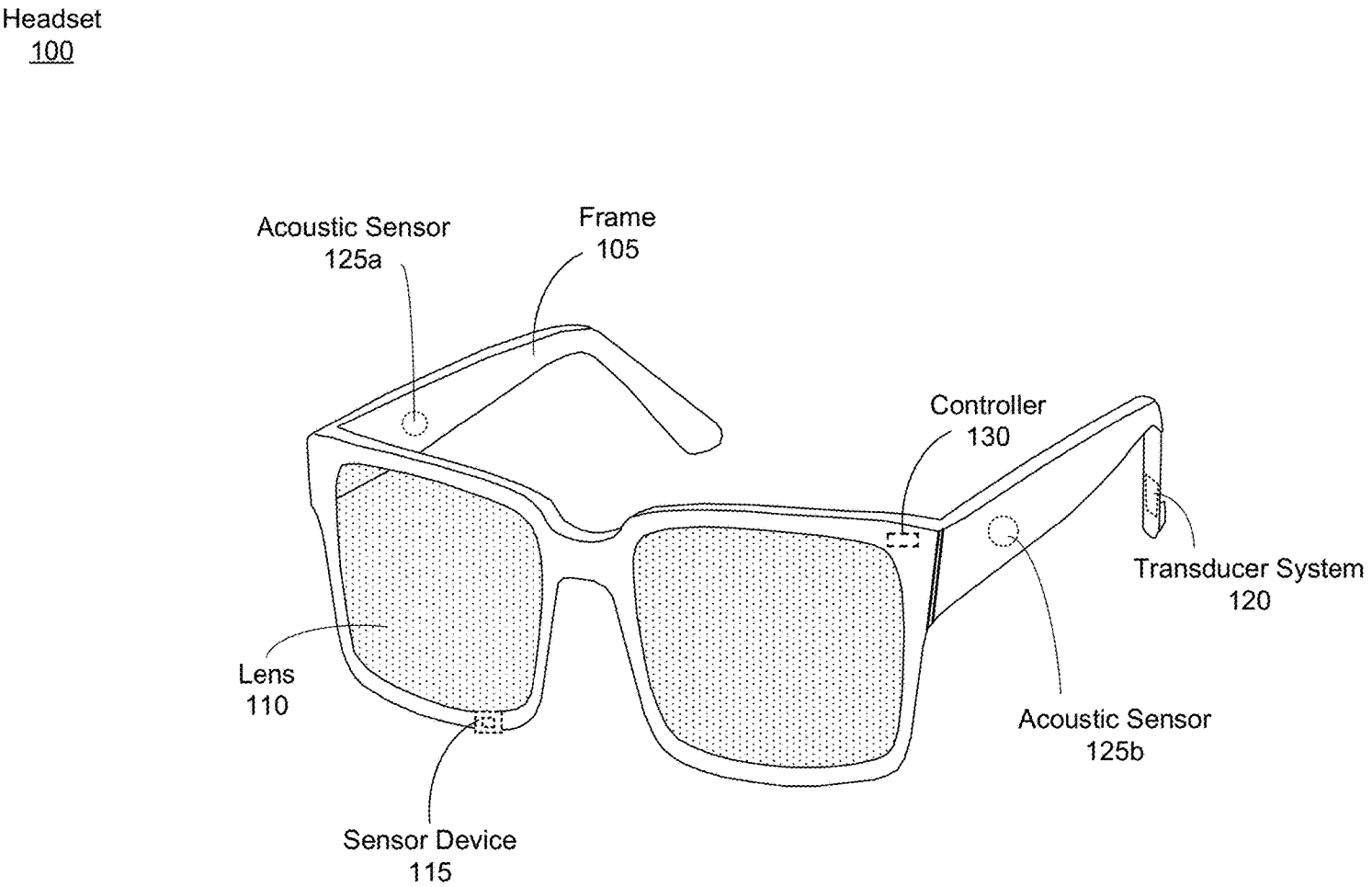
FIG. 1 is an example headset, in accordance with one or more embodiments.

The figures depict various embodiments for purposes of illustration only. One skilled in the art will readily recognize from the following discussion that alternative embodiments of these principles exist.

DETAILED DESCRIPTION

A virtual reality (VR)/augmented reality (AR) headset may present audio to a user by a tissue conduction audio system. The tissue conduction audio system may include a tissue conduction transducer that vibrates cartilage and/or bone near and/or at an ear of the user to generate acoustic pressure waves. In conventional tissue conduction audio systems, the vibrations, when in contact with the user's cartilage and/or bone, may put the spring suspension in a non-rest position with a higher spring rate thereby shifting fundamental resonances upwards in frequency. This reduces the tissue conduction transducer's low frequency extension, thus resulting in degraded audio quality and a sub-optimal experience for the user. A vibration isolation system may reduce the transfer of vibrations from the transducer to structures the transducer is mounted on, improving the user's audio experience.

The vibration isolation system may include masses and springs to internally absorb the vibrations of the transducer. In the embodiment described herein, the springs take the form of flexures. In the vibration isolation system described herein, the set of flexures has an asymmetric spring rate when unloaded and a symmetric spring rate when preloaded to a prescribed displacement offset. Accordingly, the suspension element more effectively isolates the vibrations from the transducer.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

Headset Overview

FIG. 1 is an example headset 100, in accordance with one or more embodiments. The headset 100 presents media to a user. Examples of media presented by the headset 100 include one or more images, video, audio, or some combination thereof. In one embodiment, the headset 100 may be a near-eye display (NED). In embodiments (not shown) the headset 100 may be a head-mounted display. The headset 100 may include, among other components, a frame 105, a lens 110, a sensor device 115, an audio system, and a transducer system 120. The audio system may include, among other components, one or more acoustic sensors 125 and a controller 130. The transducer system may include, among other components, a transducer and a vibration isolation system, discussed in further detail with regard to FIGS. 2-5. In some embodiments, the transducer system and/or the vibration isolation system may be on an arm of the headset 100. While FIG. 1 illustrates the components of the headset 100 in example locations on the headset 100, the components may be located elsewhere on the headset 100, on a peripheral device paired with the headset 100, or some combination thereof.

The headset 100 may correct or enhance the vision of a user, protect the eye of a user, or provide images to a user. The headset 100 may be eyeglasses which correct for defects in a user's eyesight. The headset 100 may be sunglasses which protect a user's eye from the sun. The headset 100 may be safety glasses which protect a user's eye from impact. The headset 100 may be a night vision device or infrared goggles to enhance a user's vision at night. The headset 100 may be a near-eye display that produces VR, AR, or MR content for the user. Alternatively, the headset 100 may not include a lens 110 and may be a frame 105 with an audio system that provides audio (e.g., telephony, alerts, media, music, radio, podcasts) to a user.

The frame 105 includes a front part that holds the lens 110 and end pieces to attach to the user. The front part of the frame 105 bridges the top of a nose of the user. The end pieces (e.g., temples) are portions of the frame 105 that hold the headset 100 in place on a user (e.g., each end piece extends over a corresponding ear of the user). The length of the end piece may be adjustable to fit different users. The end piece may also include a portion that curls behind the ear of the user (e.g., temple tip, ear piece).

The lens 110 provides or transmits light to a user wearing the headset 100. The lens 110 may be prescription lens (e.g., single vision, bifocal and trifocal, or progressive) to help correct for defects in a user's eyesight. The prescription lens transmits ambient light to the user wearing the headset 100. The transmitted ambient light may be altered by the prescription lens to correct for defects in the user's eyesight. The lens 110 may be a polarized lens or a tinted lens to protect the user's eyes from the sun. The lens 110 may be one or more waveguides as part of a waveguide display in which image light is coupled through an end or edge of the waveguide to the eye of the user. The lens 110 may include an electronic display for providing image light and may also include an optics block for magnifying image light from the electronic display. The lens 110 is held by a front part of the frame 105 of the headset 100.

The sensor device 115 generates one or more measurement signals in response to motion of the headset 100. The sensor device 115 may be located on a portion of the frame 105 of the headset 100. The sensor device 115 may include a position sensor, an inertial measurement unit (IMU), or both. Some embodiments of the headset 100 may or may not include the sensor device 115 or may include more than one sensor device 115. In embodiments in which the sensor device 115 includes an IMU, the IMU generates fast calibration data based on measurement signals from the sensor device 115. Examples of sensor devices 115 include: one or more accelerometers, one or more gyroscopes, one or more magnetometers, another suitable type of sensor that detects motion, a type of sensor used for error correction of the IMU, or some combination thereof. The sensor device 115 may be located external to the IMU, internal to the IMU, or some combination thereof. The sensor device 115 may include multiple accelerometers to measure translational motion (forward/back, up/down, left/right) and multiple gyroscopes to measure rotational motion (e.g., pitch, yaw, roll).

The audio system detects and processes sounds within an environment surrounding the headset 100. Some embodiments of the headset 100 may or may not include the audio system. In the embodiment of FIG. 1, the audio system includes the plurality of acoustic sensors 125 and the controller 130. Each acoustic sensor is configured to detect sounds within a local area surrounding the microphone array. In some embodiments, some of the plurality of acoustic sensors 125 are coupled to a neckband coupled to the headset 100. The controller 130 is configured to process the data collected by the acoustic sensors 125. The controller 130 may transmit data and commands to and from an artificial reality system. In some embodiments, the acoustic sensors 125 may provide audio feedback to a user in response to commands received from the artificial reality system.

The transducer system 120 is coupled to the frame 105. In the embodiment of FIG. 1, the transducer system 120 includes a transducer with an integrated vibration isolation system. The transducer is a component that converts a signal from one energy form to another energy form. Examples of transducers includes microphones, position sensors, pressure sensors, actuators, haptic engines, vibration alerts, speakers, tissue conduction, among others. The vibration isolation system isolates the vibrations produced by the transducer from a device to which the vibration isolation system is attached and/or coupled. In an embodiment of FIG. 1, the vibration isolation system isolates vibrations from the frame 105. Isolating vibrations produced by the transducer reduces the transmission of the vibrations to a user wearing the headset 100, to other components of the headset 100, or some combination thereof.

In some embodiments, the transducer system 120 is used to provide audio content to the user. Audio content may be, e.g., airborne audio content and/or tissue born audio content. For example, airborne audio content (i.e., sounds) may be generated by the transducer system being coupled to a diaphragm that vibrates with a transducer in the transducer system. The moving diaphragm generating the airborne audio content. In contrast, tissue born audio content provides audio content using tissue conduction. Tissue conduction includes one or both of bone conduction and cartilage conduction, that vibrates bone and/or cartilage to generate acoustic pressure waves in a tissue of a user.

A bone conduction audio system uses bone conduction for providing audio content to the ear of a user while keeping the ear canal of the user unobstructed. The bone conduction audio system includes a transducer assembly that generates tissue born acoustic pressure waves corresponding to the audio content by vibrating tissue in a user's head that includes bone. Tissue may include e.g., bone, cartilage, muscle, skin, etc. For bone conduction, the primary pathway for the generated acoustic pressure waves is through the bone of the head (bypassing the eardrum) directly to the cochlea. The cochlea turns tissue borne acoustic pressure waves into signals which the brain perceives as sound.

A cartilage conduction audio system uses cartilage conduction for providing audio content to an ear of a user. The cartilage conduction audio system includes a transducer assembly that is coupled to one or more portions of the auricular cartilage around the outer ear (e.g., the pinna, the tragus, some other portion of the auricular cartilage, or some combination thereof). The transducer assembly generates airborne acoustic pressure waves corresponding to the audio content by vibrating the one or more portions of the auricular cartilage. This airborne acoustic pressure wave may propagate toward an entrance of the ear canal where it would be detected by the ear drum. However, the cartilage conduction audio system is a multipath system that generates acoustic pressure waves in different ways. For example, vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. Additional details regarding bone conduction and/or cartilage conduction may be found at, e.g., U.S. patent application Ser. No. 15/967,924, filed on May 1, 2018, which in incorporated by reference in its entirety.

Vibration Isolation System

Figure 2A:
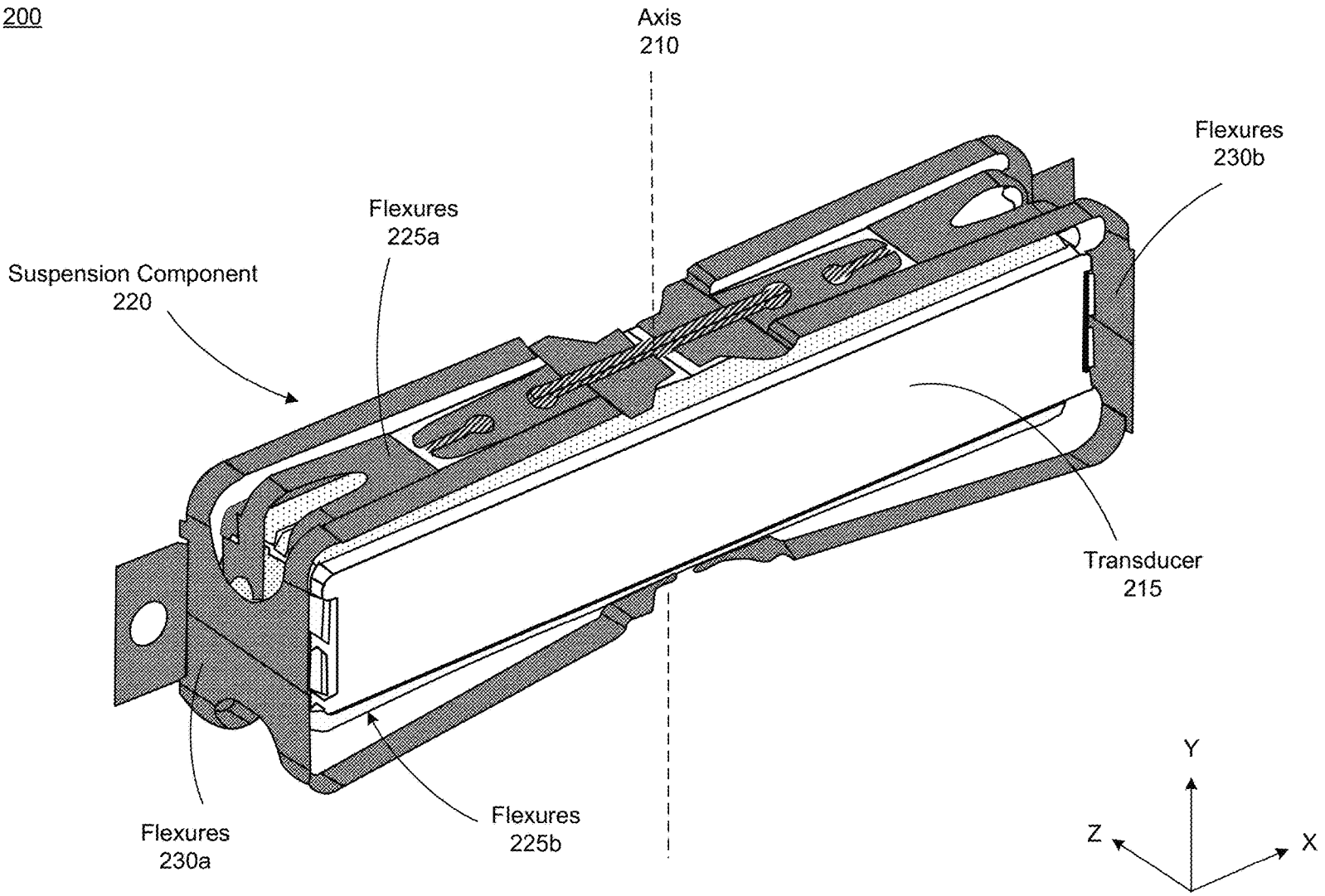
FIG. 2A is a perspective view of a vibration isolation system, in accordance with one or more embodiments.

FIG. 2A is a perspective view of a transducer with integrated vibration isolation system 200, in accordance with one or more embodiments. The vibration isolation system 200 is configured to isolate its mounting points from vibrations produced by a transducer of an audio system by oscillating along an axis 210. The vibration isolation system 200 includes a transducer 215 and a suspension component 220. The vibration isolation system 200 may include components other than those described herein. In some embodiments, the vibration isolation system 200 is a component of the transducer system 120 of the headset 100 and may be coupled to the headset 100 via securing mechanisms, adhesives, mating interfaces, or some combination thereof.

The transducer 215 produces audio for a user. In some embodiments, the transducer 215 is a tissue conduction transducer that produces audio via tissue and/or cartilage conduction, wherein cartilage and/or bone near the user's ear is vibrated to produce acoustic pressure waves. The transducer 215 is coupled to the vibration isolation system 200 and therefore, in some embodiments, is configured to move along the axis 210. The transducer 215 is made of components described with respect to FIG. 2B.

The suspension component 220 isolates vibrations produced by the transducer 215. The suspension component 220 comprises a plurality of flexures 225*a*, 225*b*, 230*a*, and 230*b* which couple to the transducer 215 and dampen vibrations from the transducer 215 that are caused by motion along the axis 210. The flexures 225*a*, 225*b* form one set of flexures that are positioned above and below the transducer, respectively. The flexures 230*a*, 230*b* are a second set of flexures positioned on the sides of the transducer. In some embodiments, the flexures 225*a*, 225*b* have an asymmetric spring rate when at rest and a symmetric spring rate when the vibration isolation system 200 is in use, as described further with respect to FIGS. 3A-B. The plurality of flexures 225*a*, 225*b*, 230*a*, and 230*b* may be made of aluminum, brass, copper, steel, nickel, titanium, a shape memory alloy (e.g., nitinol), alloys, other suitable materials, or some combination thereof. In some embodiments, the flexures 225*a*, 225*b*, 230*a*, and 230*b* are made of a material with elastic properties that mitigate breakage and/or strain caused by long term cyclical motion of the vibration isolation system 200 along the axis 210. The flexures 230*a* and 230*b* (collectively referred to as the flexures 230) may be made of a bronze alloy, such as phosphor bronze and/or coated with polyurethane. In some embodiments, the flexures 230*a* and 230*b* may be a polymer spring. In some embodiments, the suspension component 220 includes components other than those shown in FIG. 2A, such as coupling members that combine the plurality of flexures and mount to the transducer 215.

Figure 2B:
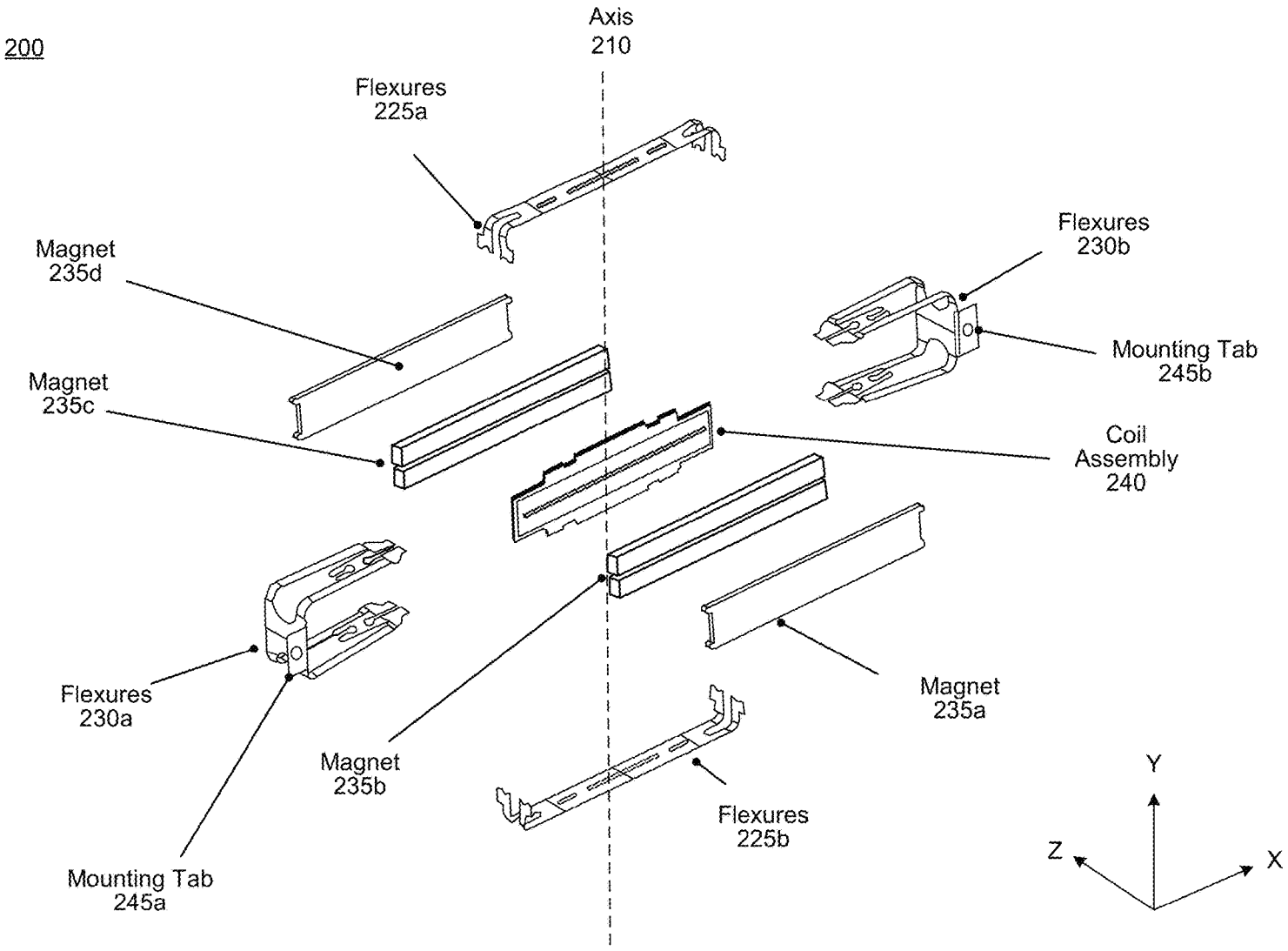
FIG. 2B is an expanded view of the vibration isolation system of FIG. 2A, in accordance with one or more embodiments.

FIG. 2B is an expanded view of the vibration isolation system 200 of FIG. 2A, in accordance with one or more embodiments. The expanded view of the vibration isolation system 200 shows components that make up the suspension component 220 and the transducer 215 (both of which are not shown in FIG. 2B). In particular, the suspension component 220 comprises the plurality of flexures 225*a*, 225*b*, 230*a*, 230*b*, while the transducer 215 comprises magnets 235*a*, 235*b*, 235*c*, 235*d*, and a coil assembly 240. The vibration isolation system 200 also includes mounting tabs 245*a*, 245*b*. In some embodiments, the vibration isolation system 200 includes components other than those shown in FIG. 2B.

As mentioned above, the transducer 215 produces audio for a user. The transducer 215 comprises the magnets 235*a*, 235*b*, 235*c*, 235*d* (collectively referred to as the magnets 235) and the coil assembly 240. Each pair of magnets may include a soft and/or hard magnet. For example, the magnets 235*a* and 235 *b* may be soft and hard magnets, respectively. A soft magnet may be made of steel and/or may be nickel plated, while a hard magnet may be a neodymium magnet and/or zinc plated. In some embodiments, the transducer 215 includes a subset of and/or more magnets than those shown in FIG. 2B.

The coil assembly 240 vibrates in response to an input signal. When electrical current passes through, the coil assembly 240 experiences Lorentz forces that cause the coil assembly 240 to vibrate along the axis 210. The coil assembly 240 may vibrate as per frequencies designated in the input signal. In some embodiments, the coil assembly 240 may be a printed circuit board (PCB) or another structure that is sufficiently rigid to receive the Lorentz forces. In some embodiments, the coil assembly 240 may include flexible printed circuitry.

The mounting tabs 245*a*, 245*b* (collectively referred to as mounting tabs 245) on the flexures 230 couple the vibration isolation system 200 to a user device, such as the headset 100. In some embodiments, as shown in FIG. 2B, the mounting tabs 245 on the flexures 230 are configured to receive a fastener to secure the vibration isolation system 200 to the device. In some embodiments, the mounting tabs 245 on the flexures 230 include one or more adhesive surfaces. The geometry of the mounting tabs 245 may be planar, polygonal, and/or another shape.

The vibration isolation system is further described in U.S. patent application Ser. No. 16/455,580, filed on Jun. 27, 2019, which is incorporated by reference in its entirety.

Figure 3A:
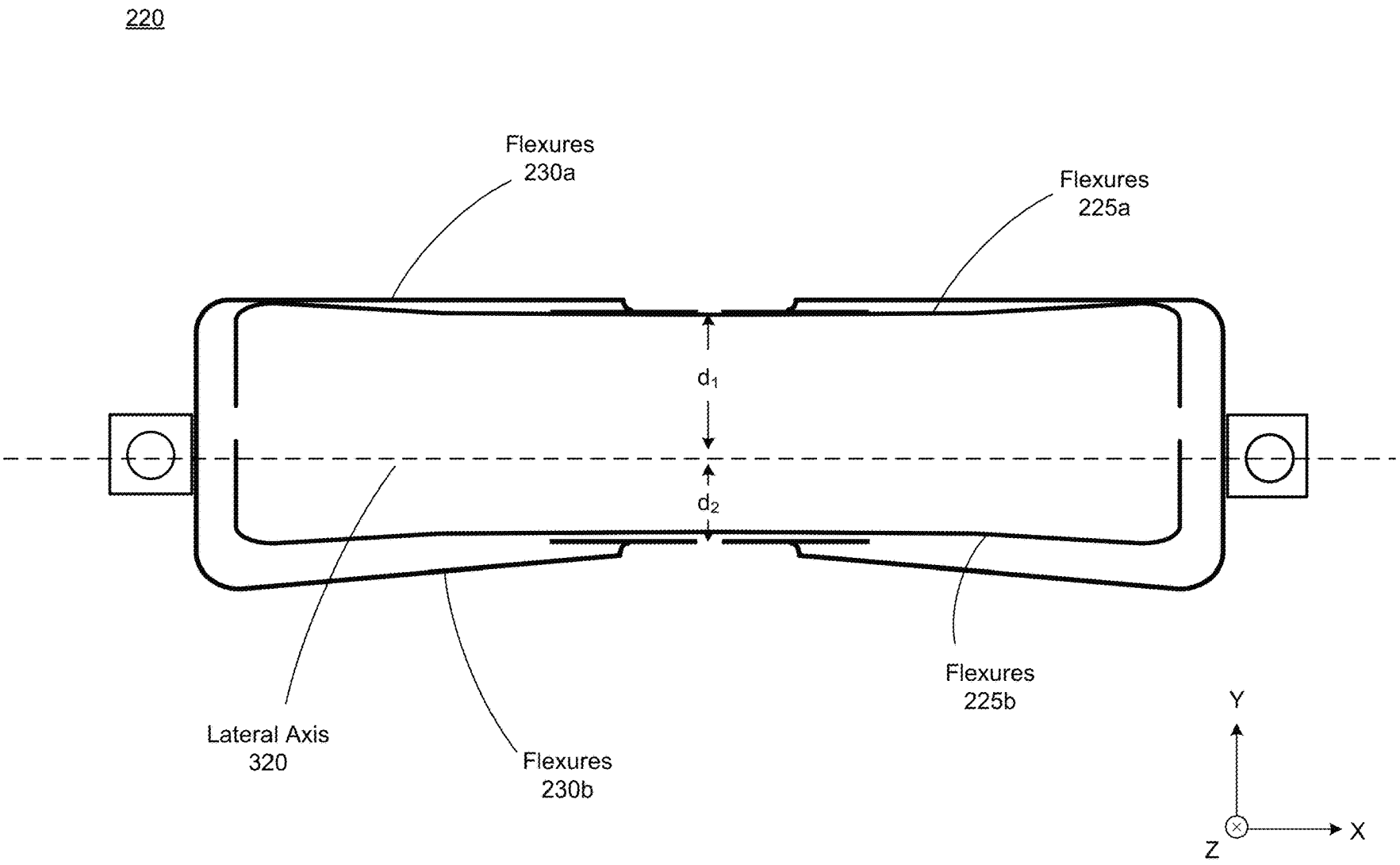
FIG. 3A is a cross-sectional view of a suspension component of the vibration isolation system of FIGS. 2A-B with a set of flexures in a rest position, in accordance with one or more embodiments.

FIG. 3A is a cross-sectional view of the suspension component 220 of the vibration isolation system 200 of FIGS. 2A-B with the set of flexures 225 and 230 in an unloaded rest position, in accordance with one or more embodiments. The suspension component 220 comprises a plurality of flexures. FIG. 3A shows the flexures 230 with respect to a lateral axis 320.

The flexures 225 and 230 are configured to isolate vibrations produced by the transducer 215, as described above. In an unloaded resting position, i.e., when the transducer 215 is not producing audio and therefore not vibrating, the flexures 230 are positioned asymmetrically along the lateral axis 320. The asymmetry of the flexures 230 is demonstrated by a distance $d_1$ from the flexures 230*a* to the lateral axis 320 being different from a distance $d_2$ from the flexures 230*b* to the lateral axis 320. The geometric asymmetry of the flexures 230 may result in an asymmetry around zero displacement in the spring rate of the flexures 230. In some embodiments, the flexures 225 are coupled to the flexures 230. In some embodiments, material properties of the flexures contribute to the asymmetric spring rates. In some embodiments, the flexures 230*a* and 230*b* may have symmetric material properties, i.e., similar material properties, but might be manufactured with the asymmetric geometry shown in FIG. 3A. In some embodiments, the flexures 225 may be geometrically symmetric in a rest position, but differing material properties of the flexures 225*a* relative to the flexures 225*b* result in the different spring rates of the flexures 225*a* and 225*b*.

Figure 3B:
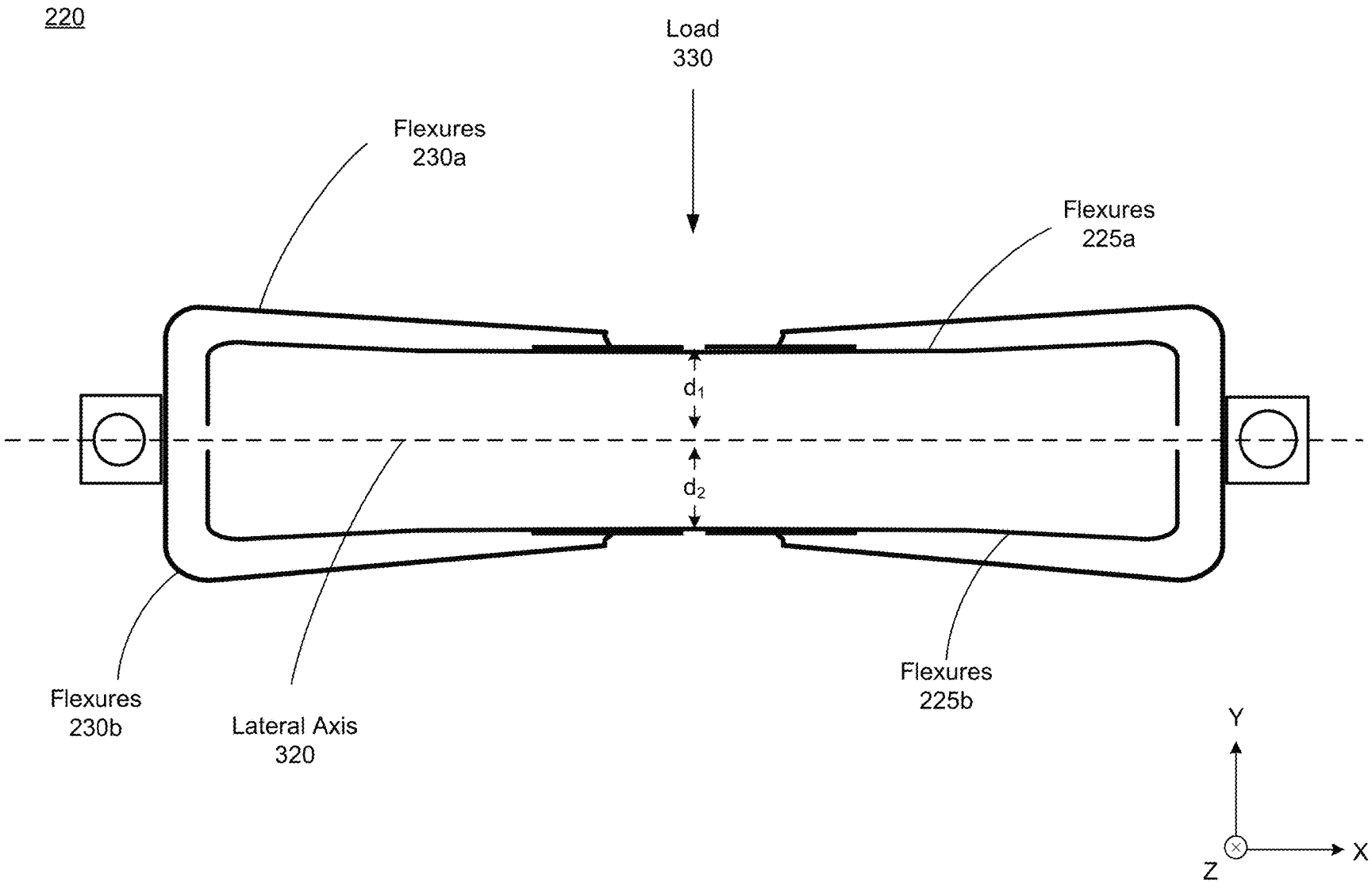
FIG. 3B is a cross-sectional view of the suspension component of the vibration isolation system of FIGS. 2A-B with the set of flexures in a target position, in accordance with one or more embodiments.

FIG. 3B is a cross-sectional view of the suspension component 220 of the vibration isolation system 200 of FIGS. 2A-B with the set of flexures 225 and 230 in a target position, in accordance with one or more embodiments. The target position may occur when the suspension component 220 bears a load 330. In bearing the load, the flexures 225 will be displaced as flexures 230 is deformed to a substantially symmetric geometry, resulting in a symmetric spring rate for the set of flexures 230. In FIG. 3B, the symmetry of the flexures 230 is demonstrated by the equal distances $d_1$ and $d_2$ of the flexures 230*a* and 230*b* from the lateral axis 320. In some embodiments, the material properties of the flexures 230, as described with respect to FIG. 2A, may facilitate the symmetry of the suspension component 220 when bearing a load.

In some embodiments, the set of flexures 230 may be positioned in the target position when the vibration isolation system 200 is coupled to a user. In some embodiments, when the user wears the headset 100, which includes the vibration isolation system 200, the vibration isolation system 200 couples to the user. For example, the vibration isolation system 200 rests against and/or contacts the user's head when in use. This occurs when the transducer 215 produces audio via tissue and/or bone conduction by vibrating a portion near and/or at the user's ear. The vibration isolation system 200's contact with the user results in the load 330 and/or displacement of the flexures 225 and 230. Accordingly, both the flexures 225 and 230 experience a symmetric spring rate when at the target position.

Figure 4:
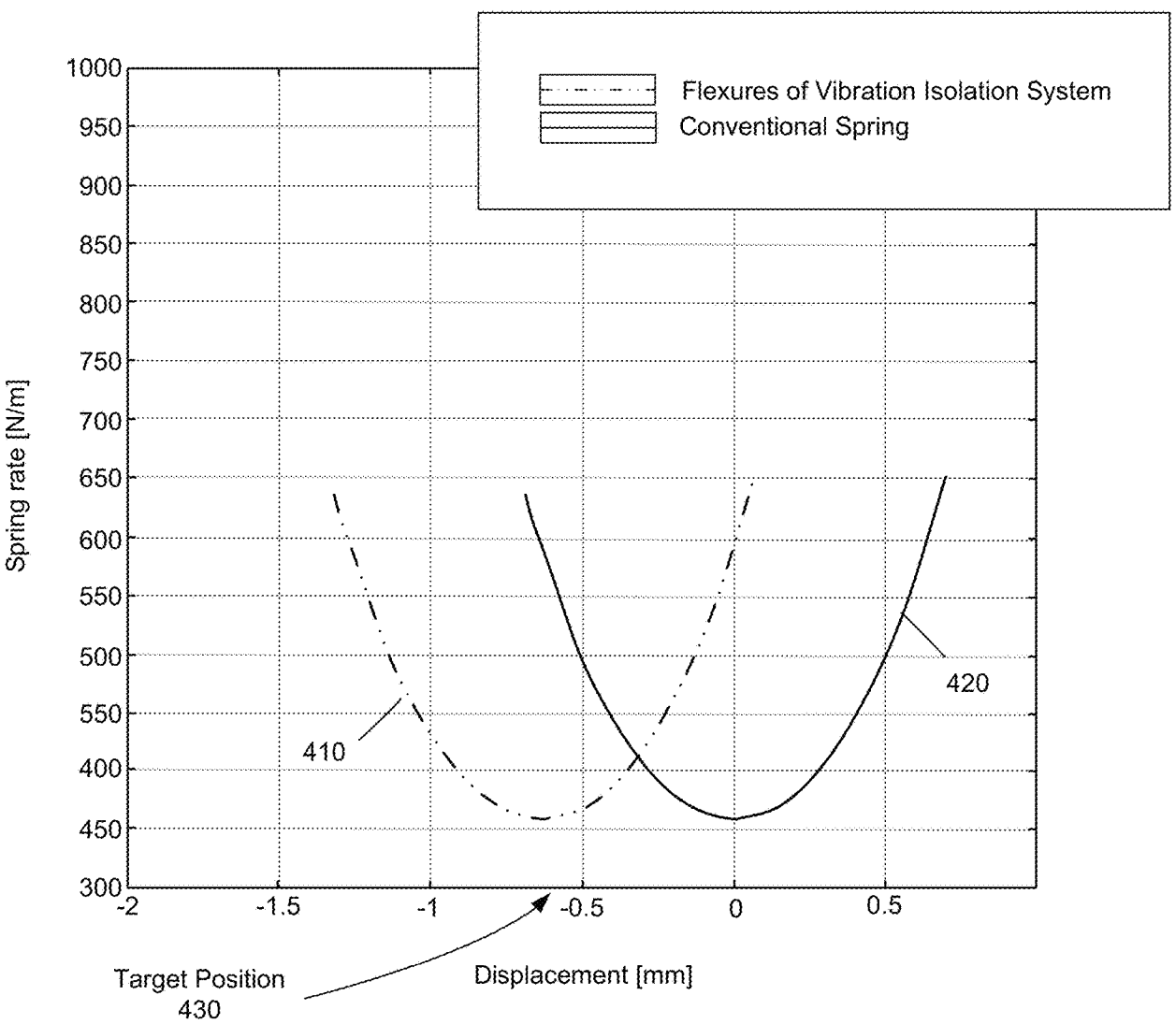
FIG. 4 is a spring rate versus displacement graph comparing the suspension component of FIGS. 3A-B with a conventional spring, in accordance with one or more embodiments.

FIG. 4 is a spring rate versus displacement graph comparing the suspension component of FIGS. 3A-B with a conventional spring, in accordance with one or more embodiments. FIG. 4 includes a plot 410 showing the spring rate of the flexures 230 and a plot 420 showing the spring rate of a zero-preload symmetric spring such as the flexures 225. A target position 430 (e.g., −0.6 mm) indicates where the vibration isolation system 200 couples to the user (e.g., at the user's ear for tissue and/or bone conduction). The plot 410 is symmetric about the target position 430, indicating that the spring rate of the flexures 230 varies symmetrically about the target position 430. The transducer 215 is thereby encouraged to maintain a range of operation about the target position 430. As per the plot 410, the transducer 215 may vibrate ±0.5 mm from the target position 430. The spring rates of the flexures 230 provides protection from mechanical displacement at high amplitudes. As the transducer 215 vibrates and the suspension component 220 travels further from the target position 430, the flexures 230 stiffen, protecting the suspension component 220 from crashing against the other components of the vibration isolation system 200.

In contrast, while the plot 420 is symmetric at no displacement (e.g., 0 mm), it is asymmetric about the target position 430. Accordingly, a conventional spring has a symmetric spring rate without a load (e.g., when not coupled to a user), but has an asymmetric spring rate about the target position 430 (e.g., when coupled to a user).

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like, in relation to manufacturing processes. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described (e.g., in relation to manufacturing processes.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A vibration isolation system comprising:

a suspension component that includes a plurality of flexures that together are configured to isolate vibrations produced by a transducer, the plurality of flexures including at least one set of flexures that have a symmetric spring rate for a target position of the at least one set of flexures, and an asymmetric spring rate for a resting position of the at least one set of flexures.

2. The vibration isolation system of claim 1, wherein the at least one set of flexures has a symmetric geometry in response to bearing a load.

3. The vibration isolation system of claim 2, wherein responsive to bearing the load, the at least one set of flexures is displaced relative to a lateral axis.

4. The vibration isolation system of claim 1, wherein the at least one set of flexures has an asymmetric spring rate due to one or more material properties.

5. The vibration isolation system of claim 4, wherein the material properties comprise one of a thickness and a type of material.

6. The vibration isolation system of claim 1, wherein the transducer is part of a headset.

7. The vibration isolation system of claim 6, wherein the target position of the at least one set of flexures occurs when the headset is coupled to a user.

8. The vibration isolation system of claim 6, wherein the vibration isolation system is positioned on an arm of the headset.

9. The vibration isolation system of claim 6, wherein the transducer is configured to present audio via at least one of bone conduction or tissue conduction.

10. A system comprising:

a transducer configured to present audio, the transducer producing vibrations while presenting the audio; and at least one set of flexures coupled to the transducer and configured to isolate the produced vibrations, wherein the at least one set of flexures have a symmetric spring rate for a target position of the at least one set of flexures, and an asymmetric spring rate for a resting position of the at least one set of flexures.

11. The system of claim 10, wherein the at least one set of flexures has a symmetric spring rate in response to bearing a load.

12. The system of claim 11, wherein responsive to bearing the load, the at least one set of flexures is displaced relative to a lateral axis.

13. The system of claim 11, wherein the at least one set of flexures has an asymmetric spring rate due to one or more material properties.

14. The system of claim 13, wherein the material properties comprise one of a thickness and a type of material.

15. The system of claim 10, wherein the transducer is part of a headset.

16. The system of claim 15, wherein the target position of the at least one set of flexures occurs when the headset is coupled to a user.

17. The system of claim 15, wherein the at least one set of flexures is positioned on an arm of the headset.

18. The system of claim 15, wherein the transducer is configured to generate sound via at least one of bone conduction or tissue conduction.

* * * * *